United States Patent [19]

Brondyke

[11] 4,073,404

[45] Feb. 14, 1978

[54] DISPENSING CARTON FOR WRAPPED DRINKING STRAWS

[75] Inventor: James R. Brondyke, Finksburg, Md.

[73] Assignee: Maryland Cup Corporation, Owings Mills, Md.

[21] Appl. No.: 726,531

[22] Filed: Sept. 27, 1976

[51] Int. Cl.[2] ..... B65H 3/34

[52] U.S. Cl. ..... 221/63; 215/1 A

[58] Field of Search ..... 221/63; 229/17 B, 51 D, 229/17 S, 7 S; 215/1 A

[56] References Cited

U.S. PATENT DOCUMENTS

| | | | |
|---|---|---|---|
| 1,198,027 | 9/1916 | Harbeck | 229/7 S |
| 1,716,628 | 6/1929 | Gittleman | 221/63 |
| 1,982,616 | 11/1934 | Medoff | 221/63 |

*Primary Examiner*—Stanley H. Tollberg
*Assistant Examiner*—Norman J. Stack, Jr.
*Attorney, Agent, or Firm*—Birch, Stewart, Kolasch & Birch

[57] ABSTRACT

A dispensing carton for individually wrapped drinking straws in which a removable panel is formed in one side wall parallel to the straws in the carton. The removal of the panel produces a slot which is longer than the straws but shorter than the wrappers so that the wrapper tips provide flexible dispensing detents for each straw.

8 Claims, 3 Drawing Figures

DISPENSING CARTON FOR WRAPPED DRINKING STRAWS

FIELD OF THE INVENTION

This invention relates to dispensing cartons and more particularly to a dispensing carton for drinking straws which have been individually wrapped in sealed wrappers.

BACKGROUND OF THE INVENTION

In establishments which dispense or deliver large quantities of drinking straws to the public, it has been the practice in the past to dispense wrapped straws from permanent reusable dispensers. This creates an additional cost factor for the customer who purchases the straws in bulk in the first place.

As an alternative to this type of straw dispensing operation, open cartons of straws have been set out on counters. This has attendant disadvantage that straws are either taken by the handful or the cartons are knocked over spilling straws all over the floor beneath the counter.

It is therefore an object of the present invention to provide a new and novel means for dispensing individually wrapped drinking straws.

It is another object of the present invention to provide new and novel cartons for dispensing individual wrapped drinking straws therefrom utilizing the wrapper as an operative element in a dispensing combination.

Yet another object of the present invention is to provide a new and novel straw dispensing carton which may be modified to dispense from a basically conventional folding carton for wrapped drinking straws by making a perforation therein which is peculiarly adapted to the present invention.

SUMMARY OF THE INVENTION

A removable perforated panel is provided in one side wall of a folding carton which is sized on its interior to receive a plurality of individually wrapped drinking straws such that the tips of the individual straw wrappers engage opposing end walls of the carton when the straws are laid in the carton in parallel stacked fashion.

The perforated panel is removable by tearing along the perforations and the resulting opening in the carton is so shaped and so proportioned as to be longer than the maximum straw length within a given wrapper but shorter than the minimum wrapper length for each straw. Therefore, the tips of each straw wrapper engage the interior walls of the side wall immediately adjacent the opening created by the removal of the perforated panel and each straw is then removable one by one by grasping it and causing the tips of the individual wrapper to flex and release the straw from the carton through the opening in the side wall.

DETAILED DESCRIPTION OF THE DRAWINGS

Figure 1:
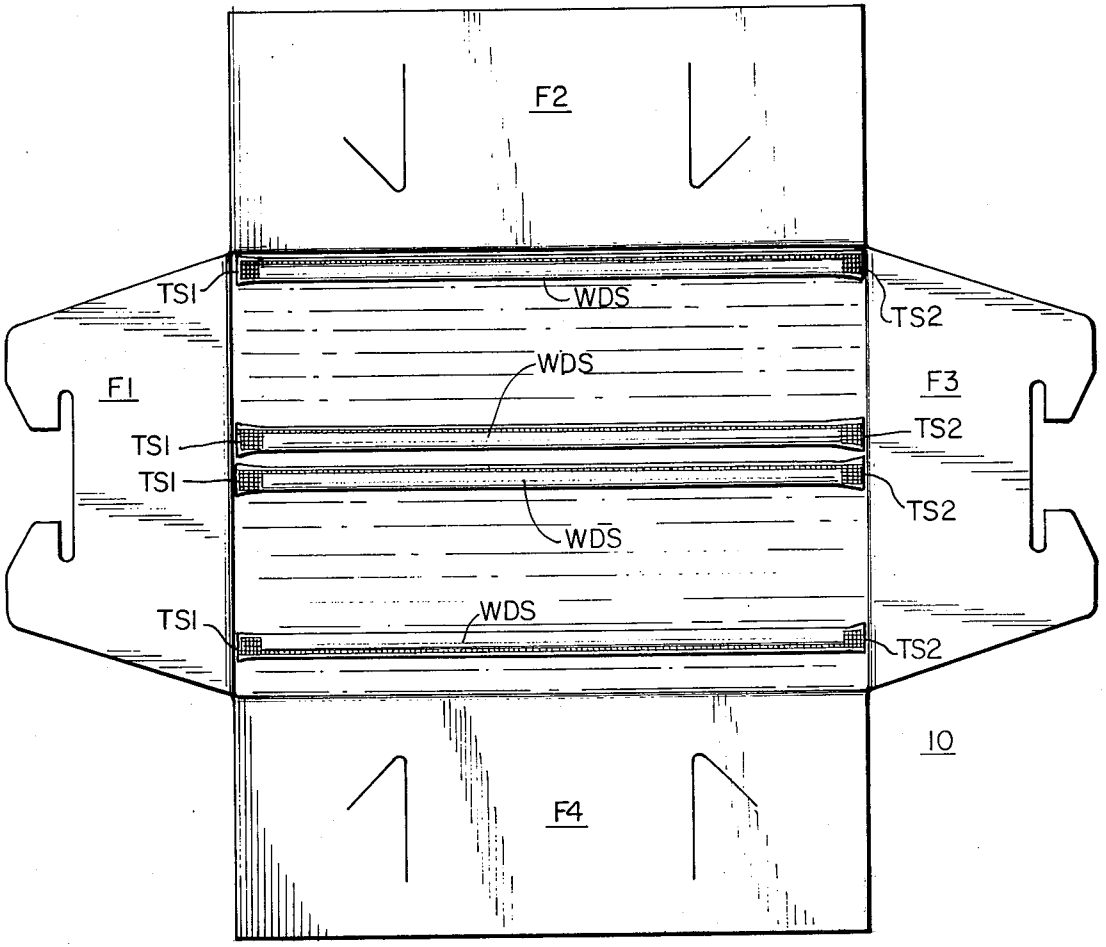
FIG. 1 is a top plan view of an open straw carton having a bulk plurality of individually wrapped drinking straws therein.
Figure 2:
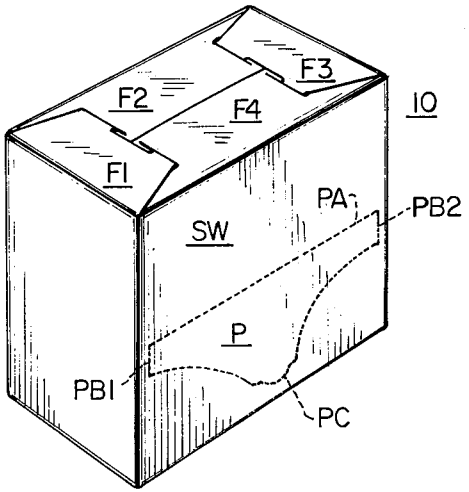
FIG. 2 is a perspective of a dispensing carton for individually wrapped drinking straws of the present invention.
Figure 3:
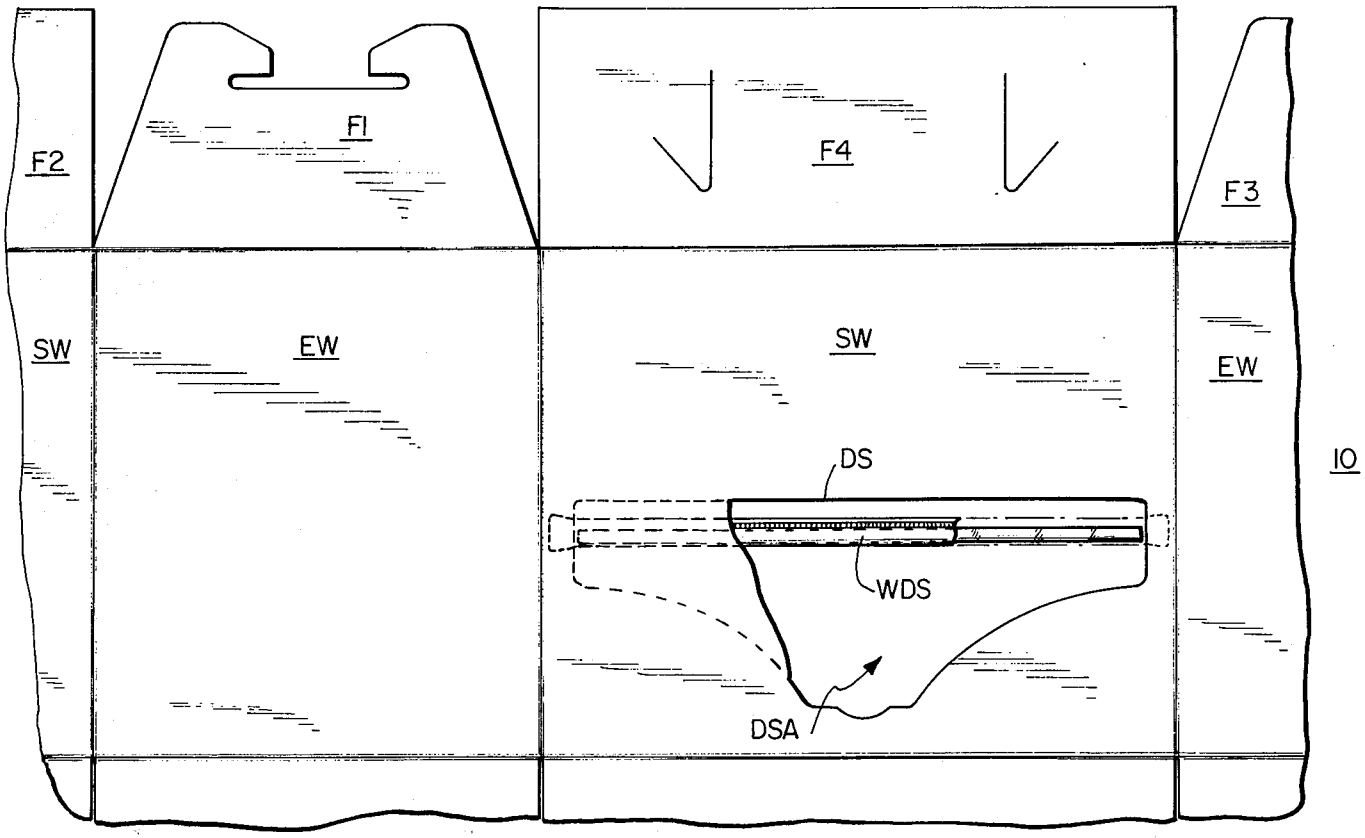
FIG. 3 is an enlarged detail illustrating a dispensing outlet embodied in a wall of the carton by a pre-determined line of perforations.

Referring in detail to FIGS. 1, 2 and 3 of the drawings, the dispensing carton 10 of the present invention is shown as including a plurality of closure flaps F. F2, F3 and F4 with end walls EW beneath the closure flaps F1 and F3 and side walls SW beneath the closure flaps F2 and F4.

A bulk quantity of wrapped drinking straws WDS are positioned within the folded and assembled carton 10 as best illustrated in FIG. 1, with the straws WDS disposed parallel to the side walls SW and the even numbered closure flaps F2 and F4. The tips of the straw wrappers TS1 at one end of the individually wrapped straws WDS are juxtaposed with or immediately adjacent to the first end wall EW beneath the closure flap F1 and the opposity tips of the straw wrappers TS2 are juxtaposed with or immediately adjacent to the second end wall EW beneath the closure flap F3.

Therefore, all of the wrapped drinking straws WDS are maintained in a substantially symmetrical position by the tips TS1 and TS2 of each of their individual wrappers.

In order to provide a means for dispensing these straws one by one from the dipsensing carton 10, there is provided a detachable panel P defined by a first row of perforations PA in a straight line configuration with two dependent perpendicular lines of perforations PB1 and PB2 dependent therefrom to define, basically, a rectangular dispensing slot DS. Then, the lower tips of the vertical perforations PB1 and PB2 are joined by a curved line of perforations PC which has a central dip therein such as to provide for the thumb of a user to punch the perforated portions inward and tear out the entire panel P. Also, the curved central portion of the perforations PC provides a widened portion DSA. The resulting dispensing slot DS formed in the side wall SW by the removal of the panel P is shaped such that the thumb and index finger of a user can be inserted into the dispensing slot DS to grasp an individual wrapped straw WDS and pull it through the slot to dispense it from the carton 10.

As can be seen from the foregoing specification and drawings, the present invention provides a new, novel, inexpensive and extremely simple dispensing device for dispensing large quantities of individually wrapped drinking straws from a carton with no additional cost whatsoever to the purchaser. Because the placing of perforations in a given side wall of a folding box blank adds nothing to the cost of the folded carton, there is no additional manufacturing expense that must be passed along to a customer.

It should be understood that the dispenser carton of the present invention may be modified as would occur to one of ordinary skill in the art without departing from the spirit and scope of the present invention.

It is claimed:

1. A dispensing carton for wrapped drinking straws having individual wrappers with tips extending beyond both ends of the straws, comprising:

an elongated hollow carton of a length substantially identical to the length of a drinking straw wrapper;

a plurality of wrapped drinking straws disposed in a mutually parallel stack lengthwise within said carton each said wrapped drinking straw comprising a straw and a tubular wrapper containing said straw, said tubular wrapper including closed end tips extending beyond the ends of said straw; and an elongated dispensing slot defined in a sidewall of said carton and extending lengthwise thereof substantially parallel to said wrapped drinking straws;

said dispensing slot being of a length less than that of said drinking straw wrappers and greater than that of straws contained in said wrappers to preclude free passage of a said wrapped straw through said dispensing slot by engagement of said sidewall adjacent said slot by the said closed end tips of said wrappers.

2. The invention defined in claim 1, wherein said dispensing slot is basically rectangular and provided with an enlarged central portion to provide access to the interior of said carton and said wrapped drinking straws.

3. The invention defined in claim 1, wherein said tubular wrappers have crimped end tips, providing resilient dispensing detents for said straws.

4. The invention defined in claim 3, wherein said dispensing slot is basically rectangular and provided with an enlarged central portion to provide access to the interior of said carton and said wrapped drinking straws.

5. The invention defined in claim 1, wherein said dispensing slot is defined by a closed line of perforations defining a removable panel in said sidewall of said carton.

6. The invention defined in claim 5, wherein said dispensing slot is basically rectangular and provided with an enlarged central portion to provide access to the interior of said carton and said wrapped drinking straws.

7. The invention defined in claim 5, wherein said tubular wrappers have crimped end tips, providing resilient dispensing detents for said straws.

8. The invention defined in claim 7, wherein said dispensing slot is basically rectangular and provided with an enlarged central portion to provide access to the interior of said carton and said wrapped drinking straws.

* * * * *